US008503910B2

(12) United States Patent
Matsuda

(10) Patent No.: US 8,503,910 B2
(45) Date of Patent: Aug. 6, 2013

(54) DRIVE DEVICE AND IMAGE FORMING APPARATUS INCLUDING SAME

(75) Inventor: Hiromichi Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 259 days.

(21) Appl. No.: 13/067,114

(22) Filed: May 10, 2011

(65) Prior Publication Data

US 2011/0280627 A1 Nov. 17, 2011

(30) Foreign Application Priority Data

May 12, 2010 (JP) ..... 2010-109903

(51) Int. Cl.
*G03G 15/00* (2006.01)

(52) U.S. Cl.
USPC ..... 399/167; 399/117; 74/414

(58) Field of Classification Search
USPC ..... 399/117, 167
See application file for complete search history.

(56) References Cited

U.S. PATENT DOCUMENTS

| | | | |
|---|---|---|---|
| 6,941,096 | B2 | 9/2005 | Matsuda et al. |
| 6,949,896 | B2 | 9/2005 | Andoh et al. |
| 6,996,357 | B2 | 2/2006 | Matsuda et al. |
| 7,251,444 | B2 | 7/2007 | Matsuda et al. |
| 7,257,339 | B2 | 8/2007 | Yokoyama et al. |
| 7,327,972 | B2 | 2/2008 | Matsuda et al. |
| 7,343,119 | B2 | 3/2008 | Matsuda et al. |
| 7,376,375 | B2 | 5/2008 | Kobayashi et al. |
| 7,386,262 | B2 | 6/2008 | Okamura et al. |
| 7,454,150 | B2 | 11/2008 | Matsuda et al. |
| 7,509,074 | B2 | 3/2009 | Yokoyama et al. |
| 7,587,157 | B2 | 9/2009 | Matsuda et al. |
| 7,684,740 | B2 | 3/2010 | Matsuda et al. |
| 7,871,073 | B2 | 1/2011 | Noguchi et al. |
| 7,885,587 | B2 | 2/2011 | Matsuda et al. |
| 2004/0086299 | A1 | 5/2004 | Matsuda et al. |

(Continued)

FOREIGN PATENT DOCUMENTS

| | | | |
|---|---|---|---|
| JP | 4559304 | A | 3/2006 |
| JP | 2007-078720 | A | 3/2007 |
| JP | 4372186 | A | 1/2009 |
| JP | 2007-065632 | A1 | 4/2009 |

OTHER PUBLICATIONS

English language abstract for patent publication No. JP-2006-085144 which corresponds to JP-4559304-A.

(Continued)

*Primary Examiner* — Walter L Lindsay, Jr.
*Assistant Examiner* — Benjamin Schmitt
(74) *Attorney, Agent, or Firm* — Harness, Dickey & Pierce, PLC

(57) ABSTRACT

A drive device to rotatively drive N number of image carriers. The drive device includes a single drive motor to generate torque to be transmitted to the image carriers, N number of drive gears to transmit the torque to the image carriers, an input gear rotatively driven by the torque and engaging a first drive gear to transmit the torque to the first drive gear, and N−1 number of idler gears provided between each of the drive gears, respectively, to transmit the torque from the drive gears provided on an upstream side to the drive gears provided on a downstream side in a direction of transmission of torque. The torque generated by the drive motor is sequentially transmitted from the first drive gear to the Nth drive gear via the idler gears to rotatively drive the image carriers.

5 Claims, 7 Drawing Sheets

U.S. PATENT DOCUMENTS

2004/0164691 A1 8/2004 Andoh et al.
2005/0053388 A1 3/2005 Yokoyama et al.
2005/0249524 A1 11/2005 Matsuda et al.
2006/0037501 A1* 2/2006 Masubuchi ..... 101/179
2006/0088338 A1 4/2006 Matsuda et al.
2006/0110189 A1 5/2006 Matsuda et al.
2006/0133873 A1 6/2006 Andoh et al.
2006/0153604 A1 7/2006 Matsuda et al.
2006/0165442 A1 7/2006 Kobayashi et al.
2006/0182471 A1 8/2006 Okamura et al.
2006/0184258 A1 8/2006 Matsuda et al.
2006/0275056 A1 12/2006 Matsuda et al.
2007/0126837 A1 6/2007 Takahashi et al.
2007/0172257 A1 7/2007 Matsuda et al.
2007/0231022 A1 10/2007 Yokoyama et al.
2008/0013972 A1 1/2008 Matsuda
2008/0170884 A1 7/2008 Matsuda
2008/0175612 A1 7/2008 Oikawa et al.
2008/0232880 A1 9/2008 Noguchi et al.
2008/0271556 A1* 11/2008 Imamura et al. ..... 74/412 R
2008/0303202 A1 12/2008 Noguchi et al.
2009/0026689 A1 1/2009 Noguchi et al.
2009/0169225 A1 7/2009 Murata et al.
2009/0190972 A1 7/2009 Ohkubo et al.
2009/0238588 A1 9/2009 Matsuda et al.
2009/0238613 A1 9/2009 Ueda et al.
2009/0263158 A1 10/2009 Murata et al.
2009/0322020 A1 12/2009 Iwata et al.
2009/0324262 A1 12/2009 Matsuda et al.
2010/0017019 A1 1/2010 Andoh et al.
2010/0239318 A1* 9/2010 Maehata et al. ..... 399/167
2010/0278560 A1* 11/2010 Ino et al. ..... 399/167
2011/0013919 A1 1/2011 Matsuda

OTHER PUBLICATIONS

English language abstract for patent publication No. JP-2009-009083 which corresponds to JP-4372186-A.

* cited by examiner

DRIVE DEVICE AND IMAGE FORMING APPARATUS INCLUDING SAME

PRIORITY STATEMENT

The present patent application claims priority from Japanese Patent Application No. 2010-109903, filed on May 12, 2010, in the Japan Patent Office, which is hereby incorporated herein by reference in its entirety.

BACKGROUND

1. Technical Field

Illustrative embodiments described in this patent specification generally relate to a drive device that rotates multiple image carriers included in an image forming apparatus, and the image forming apparatus including the drive device.

2. Description of the Related Art

Related-art full-color image forming apparatuses, such as copiers, printers, facsimile machines, and multifunction devices having two or more of copying, printing, and facsimile functions, typically include multiple image carriers (e.g., a photoconductors) arranged side by side along a direction of movement of a transfer member (e.g., an intermediate transfer belt). Using an electrophotographic method, toner images formed on surfaces of the photoconductors are transferred and superimposed one atop the other on the intermediate transfer belt to form a full-color image according to image data. Thus, for example, chargers charge the surfaces of the photoconductors; an irradiating device emits a light beam onto the charged surfaces of the photoconductors to form electrostatic latent images on the charged surfaces of the photoconductors according to the image data; developing devices develop the electrostatic latent images with a developer (e.g., toner) of respective colors to form toner images on the surfaces of the photoconductors; a transfer device transfers the toner images formed on the surfaces of the photoconductors onto the intermediate transfer belt so that the toner images are superimposed one atop the other to form a full-color toner image on the intermediate transfer belt, and further transfers the full-color toner image onto a sheet of recording media; and a fixing device applies heat and pressure to the sheet bearing the full-color toner image to fix the full-color toner image onto the sheet. The sheet bearing the fixed full-color toner image is then discharged from the image forming apparatus.

To meet recent demand for lower costs and space-saving installation, a full-color image forming apparatus in which a single drive motor is used for driving multiple photoconductors has been proposed. Two types of configurations, described below, have been often employed in the full-color image forming apparatus to meet such demand.

FIG. 1 is a schematic view illustrating a first example of a configuration employed in the related-art image forming apparatus. In this configuration, torque from a drive motor is bifurcated by an idler gear to be transmitted to each of multiple photoconductors. Specifically, a motor gear 334 of a drive motor 333 engages a first idler gear 335, and the first idler gear 335 engages each of two second idler gears 336A and 336B so that transmission of torque from the drive motor 333 is bifurcated by the first idler gear 335 into two directions to the second idler gears 336A and 336B. The second idler gear 336A engages each of two drive gears 332A and 332B, and the second idler gear 336B engages a drive gear 332C. Accordingly, the torque is further transmitted to the drive gears 332A; 332B, and 332C, respectively, to rotatively drive respective photoconductors. Thus, the three photoconductors are rotatively driven by the torque from the single drive motor 333.

FIG. 2 is a schematic view illustrating a second example of a configuration employed in the related-art image forming apparatus. In this configuration, torque transmitted from a drive motor to a single photoconductor is sequentially transmitted to the remaining photoconductors via idler gears. Specifically, drive gears 432A, 432B, 432C, and 432D corresponding to four photoconductors engage small-diameter gears 435*b*, 436*b*, 437*b*, and 438*b* of first idler gears 435, 436, 437, and 438, respectively. The first idler gears 435, 436, 437, and 438 also have large-diameter gears 435*a*, 436*a*, 437*a*, and 438*a*, respectively, and both the large-diameter gears 435*a*, 436*a*, 437*a*, and 438*a* and the small-diameter gears 435*b*, 436*b*, 437*b*, and 438*b* are coaxially provided to the respective first idler gears 435, 436, 437, and 438. The large-diameter gear 435*a* of the first idler gear 435 is connected to a first photoconductor among the four photoconductors provided at one end of an image forming apparatus in a direction of arrangement of the four photoconductors, and engages a motor gear 434 of a drive motor 433. Second idler gears 476, 477, and 478 are provided between the large-diameter gears 435*a*, 436*a*, 437*a*, and 438*a* of the first idler gears 435, 436, 437, and 438, respectively, and each of the second idler gears 476, 477, and 478 engages each of two adjacent large-diameter gears 435*a*, 436*a*, 437*a*, and 438*a*. Thus, torque from the drive motor 433 transmitted to the first idler gear 435 is further transmitted to the remaining first idler gears 436, 437, and 438 via the second idler gears 476, 477, and 478 to rotatively drive the four photoconductors by the torque from the single drive motor 433.

In the first example of the configuration illustrated in FIG. 1, provision of the first idler gear 335 is essential to bifurcate the torque from the drive motor 333. Therefore, compared to the second example of the configuration illustrated in FIG. 2, the first example needs the larger number of idler gears to rotatively drive the same number of photoconductors using the single drive motor 333, thereby increasing the number of components and installation space.

By contrast, in the second example of the configuration, the first idler gears 435, 436, 437, and 438 transmit the torque to the respective photoconductors while transmitting the torque to adjacent photoconductors provided downstream from the corresponding photoconductor in a direction of transmission of the torque. As a result, the number of idler gears can be reduced compared to the first example in which the torque from the drive motor 333 is bifurcated by the first idler gear 335, thereby reducing the number of components, production costs, and installation space.

In general, any eccentricity of a gear along a path to transmit torque from a drive motor to a photoconductor (hereinafter referred to as the torque transmission path or simply transmission path) causes rotary speed fluctuation having a sine curve rotational frequency of that gear in the photoconductor. The rotary speed fluctuation in the photoconductor causes formation of an elongated or contracted latent image on the surface of the photoconductor or transfer of an elongated or contracted toner image onto the intermediate transfer belt from the surface of the photoconductor. Consequently, a full-color toner image formed on the intermediate transfer belt is elongated or contracted. Further, when phase and amplitude of each of the toner images of the respective colors periodically elongated or contracted due to eccentricity of the gears do not coincide with one another on the intermediate transfer belt, color shift occurs upon superimposition of the toner images on the intermediate transfer belt. Even a slight shift in the toner images prominently appears as color shift in a resultant full-color image. Therefore, color shift must be accurately prevented in the full-color image forming apparatus in which the toner images of the respective colors formed on the multiple photoconductors are superimposed one atop the other to form the full-color image.

There is known a method for preventing color shift for the second example of the configuration described above. In the second example illustrated in FIG. 2, the large-diameter gears 435*a*, 436*a*, 437*a*, and 438*a* of the first idler gears 435, 436, 437, and 438 are provided along the torque transmission path as described above. As a result, eccentricity of the large-diameter gears 435*a*, 436*a*, 437*a*, and 438*a* causes rotary speed fluctuation having a rotational frequency of the respective large-diameter gears 435*a*, 436*a*, 437*a*, or 438*a* (or a rotational frequency of the first idler gears 435, 436, 437, or 438) in the respective photoconductors. In order to prevent color shift caused by the above-described rotary speed fluctuation in the photoconductors, rotational positions of each of the first idler gears 435, 436, 437, and 438 are set as follows upon mounting thereof. Specifically, the points of maximum eccentricity in the large-diameter gears 435*a*, 436*a*, 437*a*, and 438*a* have the same rotational position, respectively, when the same point on the intermediate transfer belt passes each of transfer positions on the photoconductors where the toner images are transferred onto the intermediate transfer belt. Here, rotational position means a rotational angle from the top of the first idler gears 435, 436, 437, and 438 in the vertical direction to a direction opposite a direction of rotation of the first idler gears 435, 436, 437, and 438.

In the above-described mounting method, color shift caused by eccentricity of the large-diameter gears 435*a*, 436*a*, 437*a*, and 438*a* can be prevented when the large-diameter gears 435*a*, 436*a*, 437*a*, and 438*a* are individually connected to respective drive motors. However, as described above, the second example has a configuration in which the large-diameter gears 435*a*, 436*a*, 437*a*, and 438*a* are used not only for transmitting the torque to the respective photoconductors but also for transmitting the torque from the single drive motor 433 to the photoconductors provided on a downstream side in the direction of transmission of the torque. Therefore, color shift caused by eccentricity of the large-diameter gears 435*a*, 436*a*, 437*a*, and 438*a* cannot be accurately prevented due to the following reasons.

In the second example of the configuration described above, rotary speed fluctuation caused by eccentricity of the large-diameter gears of the first idler gears for all of the photoconductors provided upstream from the remaining photoconductors in the direction of transmission of torque is superimposed on the torque transmitted to the remaining photoconductors provided downstream from the photoconductors in the direction of transmission of torque. Specifically, not only rotary speed fluctuation caused by eccentricity of the large-diameter gear 438*a* of the first idler gear 438 but also rotary speed fluctuation caused by eccentricity of the large-diameter gears 435*a*, 436*a*, and 437*a* of the first idler gears 435, 436, and 437 is superimposed to cause rotary speed fluctuation in the photoconductor provided at the extreme downstream side in the direction of transmission of torque. Therefore, the phase or amplitude of the rotary speed fluctuation thus generated in that photoconductor provided on the extreme downstream side in the direction of transmission of torque differs from the phase or amplitude of the rotary speed fluctuation in that photoconductor caused only by eccentricity of the corresponding large-diameter gear 438*a*. In the above-described method, rotary speed fluctuation in the photoconductors caused only by eccentricity of the corresponding large-diameter gear 435*a*, 436*a*, 437*a*, or 438*a* is considered. Thus, color shift due to rotary speed fluctuation in the photoconductors caused by eccentricity of all of the large-diameter gears of the first idler gears for the photoconductors provided upstream from the remaining photoconductors in the direction of transmission of torque cannot be prevented by the above-described method.

In another approach, the second example of the configuration described above is again employed in an image forming apparatus. In such an image forming apparatus, drive gears coaxially provided to photoconductors are used in place of the idler gears for transmitting torque to the photoconductors, thereby minimizing the number of idler gears and reducing production costs and installation space. However, because the second configuration described above is employed, torque transmitted to the photoconductor provided on the extreme downstream side in the direction of transmission of torque includes rotary speed fluctuation caused by eccentricity of all of the drive gears for the photoconductors provided upstream from that photoconductor in the direction of transmission of torque. Therefore, rotary speed fluctuation due to eccentricity of the drive gears for the photoconductors provided upstream from the other photoconductors in the direction of transmission of torque must be taken into consideration to accurately prevent color shift caused by eccentricity of the drive gears.

In order to accurately prevent color shift, a method for mounting drive gears described below has been proposed.

Specifically, eccentricity proportions of each of drive gears for two adjacent photoconductors is adjusted, and the drive gears are mounted at predetermined rotational positions such that phases and amplitudes of rotary speed fluctuation in the two adjacent photoconductors caused by eccentricity of the drive gears coincide with each other, respectively, when toner images are transferred from each of the two adjacent photoconductors onto the same position on the intermediate transfer belt. Accordingly, not only color shift due to rotary speed fluctuation caused by eccentricity of the drive gears for the corresponding photoconductors but also color shift due to rotary speed fluctuation caused by eccentricity of the drive gears for the photoconductors provided on an upstream side in the direction of transmission of torque can be prevented.

However, in the above-described mounting method, drive gears having a different amount of eccentricity must be manufactured. Further, a combination of the drive gears must be selected such that eccentricity proportions of the drive gears mounted to the two adjacent photoconductors has a predetermined value. Thus, during production of the image forming apparatus, the amount of eccentricity of each of the drive gears must be measured, and the combination of the drive gears that achieves the predetermined eccentricity proportions must be selected, thereby considerably increasing production costs.

In addition, plastic gears formed by, for example, injection molding has come to be widely used as the drive gears and the idler gears in recent years. Eccentricity of the plastic gears is mainly caused by formational error during injection molding. The formational error occurs due to surrounding temperature distribution during formation of the plastic gears, injection temperature distribution of resin, assembly eccentricity of the mold, and so forth. In a recent technology of accurate formation using injection molding, gears in the same lot formed by the same mold substantially have the same amount of eccentricity. Therefore, it is difficult to manufacture the drive gears that can achieve the desired predetermined eccentricity proportions described above.

SUMMARY

In view of the foregoing, illustrative embodiments described herein provide an improved drive device in which gears having substantially the same amount of eccentricity are used for transmitting torque from a single drive motor to both corresponding photoconductors and photoconductors provided downstream from the corresponding photoconductors in a direction of transmission of torque. As a result, color shift caused by eccentricity of the gears can be accurately prevented at reduced costs. Illustrative embodiments described herein further provide an image forming apparatus including the drive device.

At least one embodiment provides a drive device to rotatively drive N number of cylindrical image carriers arranged side by side along a direction of movement of a transfer member, where N is a positive integer equal to or greater than 2. The drive device includes a single drive motor to generate torque to be transmitted to the N number of image carriers, N number of drive gears including a first drive gear to transmit the torque to the N number of image carriers, respectively, an input gear rotatively driven by the torque and engaging the first drive gear included among the N number of drive gears to transmit the torque to the first drive gear, and N−1 number of idler gears provided between each of the N number of drive gears, respectively, to transmit the torque from the drive gears provided on an upstream side in a direction of transmission of torque to the drive gears provided on a downstream side in the direction of transmission of torque. The torque generated by the drive motor is sequentially transmitted from the first drive gear to the Nth drive gear via the N−1 number of idler gears to rotatively drive the N number of image carriers. Each of the N number of drive gears has substantially the same amount of eccentricity. The input gear, the N number of drive gears, and the N−1 number of idler gears are disposed to cause both a first setting angle between a first engagement point where the input gear engages the first drive gear and a second engagement point where a first idler gear included among the N−1 number of idler gears engages the first drive gear and a second setting angle between a third engagement point where the (n−1)th idler gear included among the N−1 number of idler gears, where n is a positive integer between 2 and (N−1), engages the nth drive gear included among the N number of drive gears and a fourth engagement point where the nth idler gear included among the N−1 number of idler gears engages the nth drive gear to be set to $\theta i$ obtained by a formula $\theta i = n - \phi \pm e$, where e is an acceptable amount of error. The N number of drive gears are mounted to offset a rotational position of a point of maximum eccentricity in the nth drive gear from a rotational position of a point of maximum eccentricity in the first drive gear in a direction of rotation of the nth drive gear by an angle Gan obtained by a formula $\theta an = (n-1)\phi$ when n is an odd integer, and by an angle $\theta an$ obtained by a formula $\theta an = \theta i + (n-1)\phi$ when n is an even integer. $\phi$ is obtained by a formula $$\phi = -2\pi \frac{(Ls - uLd)}{Ld}$$

when the N number of image carriers are arranged in order from the first image carrier to the Nth image carrier in the direction of movement of the transfer member, and is obtained by a formula $$\phi = 2\pi \frac{(Ls - uLd)}{Ld}$$

when the N number of image carriers are arranged in order from the first image carrier to the Nth image carrier in a direction opposite the direction of movement of the transfer member, where Ls is a distance between rotary shafts of each of two adjacent image carriers included among the N number of image carriers, Ld is a running distance of a surface of each of the N number of image carriers while each of the N number of drive gears makes a single rotation, and u is an integer representing a number of rotations made by each of the N number of drive gears while the transfer member is moved by Ls.

At least one embodiment provides an image forming apparatus including N number of rotatable cylindrical image carriers to form images on surfaces thereof, respectively, where N is a positive integer equal to or greater than 2, a transfer member onto which the images are sequentially transferred one atop the other from the surfaces of the N number of image carriers arranged side by side along a direction of movement of the transfer member, and the drive device described above.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments described herein and the many attendant advantages thereof will be readily obtained as the same becomes better understood by reference to the following detailed description when considered in connection with the accompanying drawings, wherein.

Figure 1:
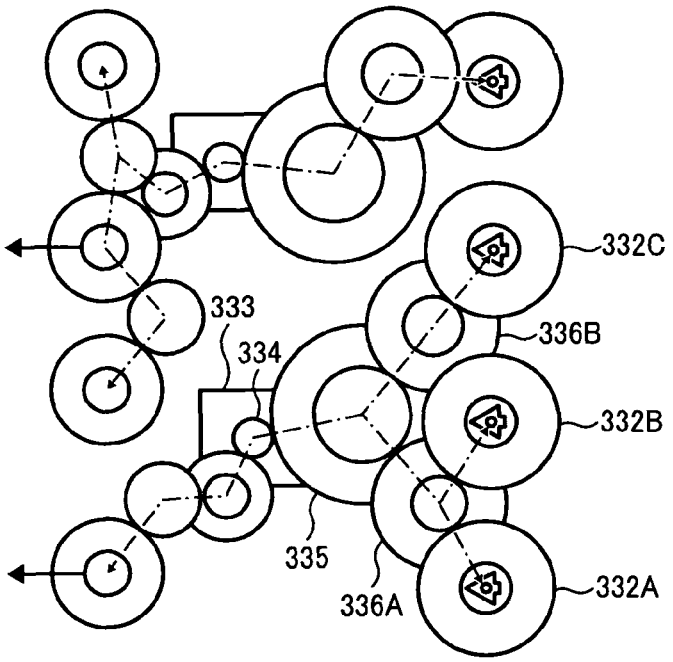
FIG. 1 RELATED ART
FIG. 1 is a schematic view illustrating an example of a configuration of a related-art image forming apparatus.
Figure 2:
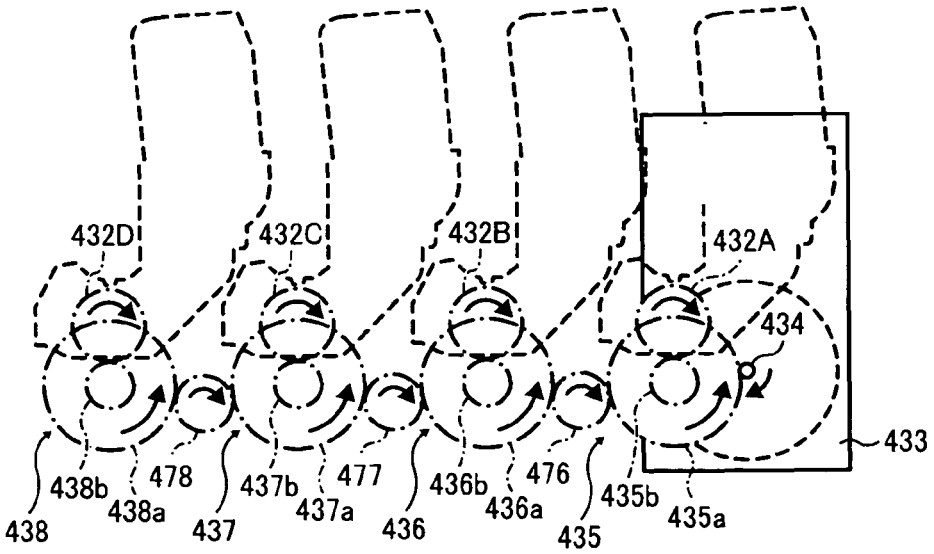
FIG. 2 RELATED ART
FIG. 2 is a schematic view illustrating another example of a configuration of a related-art image forming apparatus.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

A description is now given of illustrative embodiments of the present invention with reference to drawings, wherein like reference numerals designate identical or corresponding parts throughout the several views.

Figure 3:
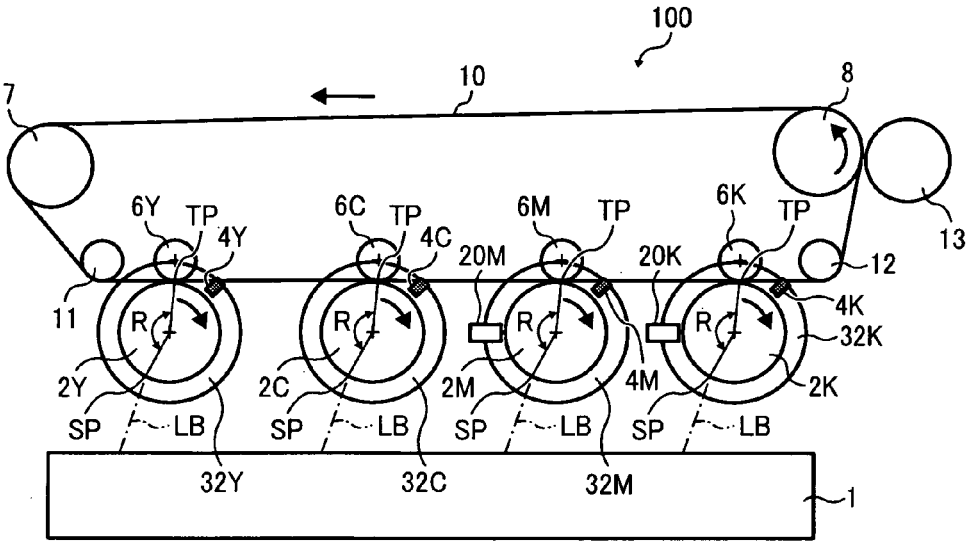
FIG. 3 is a vertical cross-sectional view illustrating an example of a configuration of an image forming apparatus according to illustrative embodiments.

A configuration and operation of a tandem type full-color image forming apparatus employing an intermediate transfer system (hereinafter referred to as an image forming apparatus 100) are described in detail below with reference to FIG. 3. FIG. 3 is a vertical cross-sectional view illustrating an example of a configuration of main components in the image forming apparatus 100 according to illustrative embodiments. It is to be noted that a sheet feed table that holds the large number of sheets, a scanner, or an automatic document feeder (ADF) may be provided to the image forming apparatus 100 as needed in addition to the main components shown in FIG. 3 when the image forming apparatus 100 is used as a copier or a printer.

The image forming apparatus 100 includes a seamless intermediate transfer belt 10 serving as a transfer member wound around four rotary support bodies, that is, support rollers 7, 8, 11, and 12. The support roller 8 serves as a drive roller to rotate the intermediate transfer belt 10 in a counterclockwise direction in FIG. 3. Although not shown in FIG. 3, a belt cleaning device is provided on the left of the support roller 7 to remove residual toner from the intermediate transfer belt 10 after a full-color toner image is secondarily transferred onto a sheet of a recording medium. In addition, four image forming units each forming toner images of a specific color, that is, yellow (Y), cyan (C), magenta (M), or black (K), are arranged side by side along the intermediate transfer belt 10 between the support rollers 11 and 12. The image forming units include photoconductors 2Y, 2C, 2M, and 2K (hereinafter collectively referred to as photoconductors 2), drive gears 32Y, 32C, 32M, and 32K (hereinafter collectively referred to as drive gears 32), and bias rollers 6Y, 6C, 6M, and 6K (hereinafter collectively referred to as bias rollers 6), respectively. Each of the photoconductors 2 serves as an image carrier and is rotatively driven in a clockwise direction in FIG. 3. The image forming units further include chargers, developing devices, cleaning devices, and so forth around the photoconductors 2, respectively. Each of the four image forming units has the same basic configuration, differing only in the color of toner used.

The bias rollers 6 are provided opposite the photoconductors 2 with the intermediate transfer belt 10 interposed therebetween, respectively, and cause the intermediate transfer belt 10 to contact each of the photoconductors 2. Each of the drive gears 32 is formed by the same mold in the same lot, and has at least one mark 4Y, 4C, 4M, or 4K (hereinafter collectively referred to as marks 4) on a lateral surface thereof in a circumferential direction, respectively. Because molding error in gears formed by the same mold in the same lot tends to be the same, relative eccentric phases of the drive gears 32 can be adjusted based on the marks 4. The mark 4K of the drive gear 32K is detected by a position sensor 20K so that a rotational phase of the photoconductor 2K can be obtained based on a result detected by the position sensor 20K.

The image forming apparatus 100 further includes an irradiating device 1 serving as a latent image forming unit provided below the four image forming units. In addition, a secondary transfer roller 13 serving as a secondary transfer unit is provided at a position opposite the support roller 8 with the intermediate transfer belt 10 interposed therebetween. The secondary transfer roller 13 is pressed toward the support roller 8 to be pressed against the intermediate transfer belt 10. A recording medium such as a sheet of paper is conveyed from a bottom part of the image forming apparatus 100 to a nip (or a secondary transfer position) formed between the secondary transfer roller 13 and the intermediate transfer belt 10 at a predetermined timing. A full-color toner image formed on the intermediate transfer belt 10 is secondarily transferred onto the sheet at the secondary transfer position by pressure and voltage applied from the secondary transfer roller 13. It is to be noted that, a transfer belt or a contactless charger may be alternatively used as the secondary transfer unit.

Although not shown, a fixing device that fixes the full-color toner image transferred from the intermediate transfer belt 10 onto the sheet is provided above the secondary transfer roller 13.

A description is now given of image formation performed by the image forming apparatus 100. In a case of using the image forming apparatus 100 as a copier, first, a document is set either on a document stand of an automatic document feeder (ADF) or a contact glass of a scanning unit. When set on the document stand, the document is conveyed onto the contact glass after a start bottom is pressed, and then a scanner of the scanning unit is driven. On the other hand, when set on the contact glass, the scanner is driven after the start bottom is pressed. While the scanner scans, light emitted from a light source is directed onto the document. Light reflected from the document is received by a reading sensor through an imaging lens so that an image of the document is read. Image formation is performed using image data based on the image thus read. Alternatively, in a case of using the image forming apparatus 100 as a printer, image data sent from an external device such as a personal computer or a digital camera may be used to perform image formation.

While the image data is read or received, the support roller 8 is rotatively driven by a drive motor for the intermediate transfer belt 10. Accordingly, the intermediate transfer belt 10 is rotated in the counterclockwise direction in FIG. 3, and the support rollers 7, 11, and 12, which are driven rollers, are rotated as the intermediate transfer belt 10 is rotated. At the same time, the photoconductors 2 are rotated in the clockwise direction by a drive motor 33 shown in FIG. 4 described later. A light beam LB is directed from the irradiating device 1 onto each of surfaces of the photoconductors 2 so that electrostatic latent images of the specified color, that is, yellow (Y), cyan (C), magenta (M), or black (K), are formed on the surfaces of the photoconductors 2, respectively, based on the image data of the respective colors. The electrostatic latent images thus formed are then developed with toner of the respective colors by the developing devices. Accordingly, toner images of the respective colors are formed on the surfaces of the photoconductors 2. The toner images thus formed are primarily transferred onto the intermediate transfer belt 10 and are superimposed one atop the other so that a full-color toner image is formed on the intermediate transfer belt 10.

While the full-color toner image is formed on the intermediate transfer belt 10, a sheet is conveyed to the secondary transfer position at a predetermined timing. Specifically, the sheet fed from a sheet feed cassette is separated from each other by a separation roller to be conveyed to a sheet feed path. The sheet is further conveyed to a pair of registration rollers by conveyance rollers. When contacting the pair of registration rollers, conveyance of the sheet is temporarily stopped. Alternatively, the sheet may be fed from a manual sheet feed tray by rotating sheet feed rollers. The sheet thus manually fed is separated from each other by a separation roller to be conveyed to a manual sheet feed path, and conveyance of the sheet is temporarily stopped when contacting the pair of registration rollers. Thereafter, the pair of registration rollers is rotated in synchronization with the full-color toner image formed on the intermediate transfer belt 10 to convey the sheet to the secondary transfer position. Although the pair of registration rollers is generally grounded, alternatively, a bias may be applied to the pair of registration rollers in order to remove paper powder of the sheet. The full-color toner image formed on the intermediate transfer belt 10 is secondarily transferred onto the sheet at the secondary transfer position by a secondary transfer bias applied to the secondary transfer roller 13. The sheet having the transferred full-color toner image thereon is then conveyed to the fixing device. In the fixing device, heat and pressure are applied to the sheet so that the full-color toner image is fixed onto the sheet. The sheet having the fixed full-color image thereon is then discharged to a discharge tray by discharge rollers.

Although the above example describes formation of full-color images, monochrome images can be formed by the image forming apparatus 100. During monochrome image formation, the intermediate transfer belt 10 is separated from the photoconductors 2Y, 2C, and 2M by a separation unit, not shown. It is preferable that driving of these three photoconductors 2Y, 2C, and 2M be temporarily stopped during monochrome image formation.

The image forming apparatus 100 has a shorter sheet conveyance path from sheet feed to sheet discharge to simplify the configuration thereof, thereby making the image forming apparatus 100 more compact. Further, the image forming apparatus 100 provides improved productivity and prevents paper jam.

Figure 4:
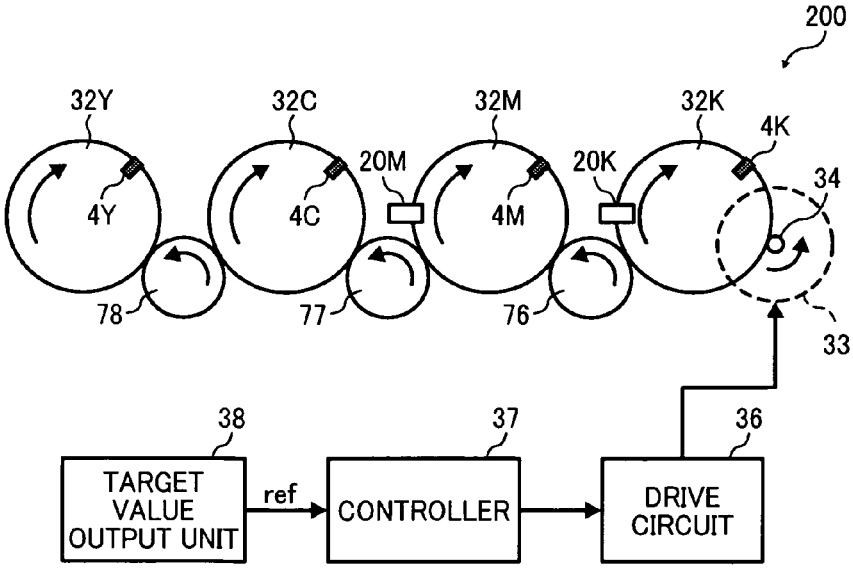
FIG. 4 is a schematic view illustrating an example of a configuration of a drive device included in the image forming apparatus illustrated in FIG. 3.

A description is now given of a drive device 200 included in the image forming apparatus 100 with reference to FIG. 4. FIG. 4 is a schematic view illustrating an example of a configuration of the drive device 200 included in the image forming apparatus 100.

The drive device 200 is fixed to a substrate, not shown, provided to the image forming apparatus 100 to achieve a drive system that transmits torque to the four photoconductors 2 using the single drive motor 33 and gear trains. Although a DC brushless motor or a stepping motor driven at a constant drive speed is used as the drive motor 33 in the above-described example, examples of the drive motor 33 are not limited thereto.

A motor gear 34 serving as an input gear is mounted to a drive shaft of the drive motor 33 and engages the drive gear 32K serving as a first drive gear provided coaxially to a rotary shaft of the photoconductor 2K. The drive gear 32K is coupled to the rotary shaft of the photoconductor 2K so that torque is transmitted from the drive gear 32K to the photoconductor 2K.

Torque is further transmitted from the drive gear 32K to the drive gear 32M serving as a second drive gear through a first idler gear 76 so as to rotate the photoconductor 2M provided next to the photoconductor 2K. The drive gear 32M is coupled to a rotary shaft of the photoconductor 2M so that the torque is transmitted from the drive gear 32M to the photoconductor 2M.

Torque is then further transmitted from the drive gear 32M to the drive gear 32C serving as a third drive gear through a second idler gear 77 so as to rotate the photoconductor 2C provided next to the photoconductor 2M. The drive gear 32C is coupled to a rotary shaft of the photoconductor 2C so that torque is transmitted from the drive gear 32C to the photoconductor 2C.

Finally, torque is further transmitted from the drive gear 32C to the drive gear 32Y serving as a fourth drive gear through a third idler gear 78 so as to rotate the photoconductor 2Y provided next to the photoconductor 2C. The drive gear 32Y is coupled to a rotary shaft of the photoconductor 2Y so that torque is transmitted from the drive gear 32Y to the photoconductor 2Y.

The first idler gear 76 engages each of the drive gears 32K and 32M to transmit torque from the drive gear 32K to the drive gear 32M. The second idler gear 77 engages each of the drive gears 32M and 32C to transmit torque from the drive gear 32M to the drive gear 32C. The third idler gear 78 engages each of the drive gears 32C and 32Y to transmit torque from the drive gear 32C to the drive gear 32Y.

The first idler gear 76 is either a gear having an electromagnetic clutch or a mechanism supported by a rocking link so as to control transmission of torque from the drive gear 32K to the drive gears 32M, 32C, and 32Y provided downstream from the drive gear 32K in a direction of transmission of torque. Accordingly, for example, transmission of torque by the first idler gear 76 from the drive gear 32K to the rest of the drive gears 32M, 32C, and 32Y is stopped during monochrome image formation. As a result, torque is not transmitted to the drive gears 32M, 32C, and 32Y to prevent unnecessary rotation of the photoconductors 2M, 2C, and 2Y, each of which is not used for monochrome image formation.

The marks 4 that show a rotational position of each of the drive gears 32 that corresponds to a point of maximum eccentricity in each of the drive gears 32 are formed on the drive gears 32, respectively. Because they are formed simply in order to obtain a phase reference for an amount of eccentricity of each of the drive gears 32, alternatively the marks 4 may be formed at a point of minimum eccentricity in each of the drive gears 32 in place of the point of maximum eccentricity.

As described in detail later, the drive gears 32 are set to have predetermined relative eccentric phases in order to prevent rotary speed fluctuation in the photoconductors 2 caused by eccentricity of the drive gears 32. In other words, rotational positions at the points of maximum eccentricity in each of the drive gears 32 are set to have predetermined relative positions.

As described above, a mechanism, not shown, is provided to control transmission of torque by the first idler gear 76 from the drive gear 32K to the rest of the drive gears 32M, 32C, and 32Y provided downstream from the drive gear 32K in the direction of transmission of torque. Consequently, the drive gear 32K and the rest of the drive gears 32M, 32C, and 32Y can get out of phase. To solve this problem, position sensors 20K and 20M for detecting rotational positions of the drive gears 32K and 32M, respectively, are provided to detect the rotational positions (or the eccentric phases) of the drive gears 32M, 32C, and 32Y. Because the drive gears 32M, 32C, and 32Y are constantly connected to one another via the second and third idler gears 77 and 78, a position sensor needs to be provided to only one of the drive gears 32M, 32C, and 32Y.

A speed sensor that detects rotary conditions of the drive motor 33 is mounted to a motor shaft of the drive motor 33. A signal detected by the speed sensor is output to a drive circuit 36 of the drive motor 33 through a controller 37 so that the drive motor 33 is controlled to have a desired rotary speed. Examples of the speed sensor having a motor therewithin include, but are not limited to, a printed coil type frequency generator (FG) and an MR sensor.

The drive circuit 36 outputs a predetermined drive current to the drive motor 33. The drive motor 33 employs a DC brushless motor having the above-described speed sensor, that is, a DC servo motor. The DC servo motor includes a rotor and coils which are star-connected in three phases of U-phase, V-phase, and W-phase. In addition, three Hall elements each serving as a position detector that detects a magnetic pole of the rotor are included in the DC servo motor, and output terminals of the Hall elements are connected to the drive circuit 36. In a case in which the DC servo motor includes a built-in MR sensor, a rotary speed detector having the MR sensor and a magnetic pattern magnetized on a circumference of the rotor is included in the DC servo motor, and an output terminal of the rotary speed detector is connected to the controller 37. The drive circuit 36 includes three high-side transistors and three low-side transistors respectively connected to the U-phase, the V-phase, and the W-phase of the coils. The drive circuit 36 specifies a position of the rotor based on a signal generated by the Hall elements to generate a phase changeover signal. The phase changeover signal controls the transistors of the drive circuit 36 to turn on and off, so that phases to be excited are sequentially switched to rotate the rotor.

The controller 37 compares rotary speed data detected by the speed sensor with target rotary speed data, and generates and outputs a PWM signal to cause the detected rotary speed of the motor shaft of the drive motor 33 to reach target rotary speed. The PWM signal is ANDed with the phase changeover signal of the drive circuit 36 by an AND gate to chop a drive current so that the rotary speed of the drive motor 33 is controlled. The controller 37 includes a well-known PLL control circuit system that compares a phase or a frequency of a pulse signal output from the speed sensor with a phase or a frequency of a pulse signal output from a target value output unit 38. The target value output unit 38 outputs a pulse signal of which frequency is modulated depending on the target rotary speed that corrects preset rotary speed fluctuation in the photoconductors 2 for a single rotation. A digital circuit may be used for the controller 37 in place of an analog circuit. In a case in which the digital circuit is used for the controller 37, a frequency of a waveform output from the speed sensor is measured to calculate a rotational angular speed. Alternatively, the number of pulses output from the speed sensor may be counted to calculate rotational angular speed based on the number of pulses counted within a predetermined period of time. It is to be noted that, in a case in which a positional control system that controls a rotational angular displacement in place of the rotational angular speed is employed, the number of pulses output from the speed sensor is counted to calculate an amount of displacement of a rotational angle. Then, a difference from target data output from the target value output unit 38 is calculated, and the drive motor 33 is driven to reduce the difference thus calculated. A PID controller or the like is generally incorporated in the controller 37 so that the drive motor 33 is controlled to have the target rotary speed without deviation, overshoot, and oscillation to output the PWM signal to the drive circuit 36.

A description is now given of a method for mounting the drive gears 32 according to a first illustrative embodiment.

Rotary speed fluctuation occurs in each of the photoconductors 2 due to eccentricity of each of the drive gears 32 that transmit torque to the photoconductors 2. Rotary speed fluctuation in the photoconductors 2 periodically elongates or contracts the toner images of the respective colors primarily transferred onto the intermediate transfer belt 10 from the surfaces of the photoconductors 2 at a frequency of a single rotation of each of the drive gears 32. At this time, color shift occurs when amplitudes and phases of each of the toner images periodically elongated or contracted are offset from one another on the intermediate transfer belt 10, thereby degrading image quality. Therefore, relative eccentric phases of the drive gears 32 are adjusted so that the amplitudes and phases of the toner images periodically elongated or contracted due to eccentricity of the drive gears 32 coincide with one another on the intermediate transfer belt 10.

The drive gears 32K, 32M, and 32C transmit torque to the drive gears 32 provided downstream therefrom in the direction of transmission of torque as well as the corresponding photoconductors 2K, 2M, and 2C. Consequently, not only rotary speed fluctuation due to eccentricity of the corresponding drive gears 32 but also rotary speed fluctuation due to eccentricity of the drive gears 32 provided upstream from the corresponding drive gears 32 in the direction of transmission of torque occur in the photoconductors 2 provided on a downstream side in the direction of transmission of torque. Specifically, rotary speed fluctuation due to eccentricity of the drive gear 32K is added to rotary speed fluctuation due to eccentricity of the drive gear 32M to cause rotary speed fluctuation in the photoconductor 2M. Similarly, rotary speed fluctuation due to eccentricity of each of the drive gears 32K and 32M is added to rotary speed fluctuation due to eccentricity of the drive gear 32C to cause rotary speed fluctuation in the photoconductor 2C. Further, rotary speed fluctuation due to eccentricity of each of the drive gears 32K, 32M, and 32C is added to rotary speed fluctuation due to eccentricity of the drive gear 32Y to cause rotary speed fluctuation in the photoconductor 2Y. Therefore, not only eccentricity of the corresponding drive gears 32 but also eccentricity of the drive gears 32 provided upstream from the corresponding drive gears 32 in the direction of transmission of torque need to be taken into consideration in order to adjust the eccentric phases of each of the drive gears 32M, 32C, and 32Y.

It is to be noted that, rotary speed fluctuation in the photoconductors 2 caused by eccentricity of the corresponding drive gears 32 hereinafter means the rotary speed fluctuation added by rotary speed fluctuation caused by eccentricity of the drive gears 32 provided upstream from the corresponding drive gears 32 in the direction of transmission of torque.

In the method for mounting the drive gears 32 according to the first illustrative embodiment, first, relative positions of the gears in the gear train that drives the photoconductors 2 are determined. The relative positions of the gears are obtained from a diameter D of each of the photoconductors 2 and a distance Ls between each of the rotary shafts of the two adjacent photoconductors 2. Next, relative rotational positions or eccentric phases of the drive gears 32 are adjusted such that amplitudes and phases of rotary speed fluctuation in the photoconductors 2 caused by eccentricity of the corresponding drive gears 32 coincide with one another when the same point on the intermediate transfer belt 10 passes transfer positions TP on each of the photoconductors 2 from where the toner images of the respective colors are transferred onto the intermediate transfer belt 10. Then, the drive gears 32 are mounted.

Figure 5:
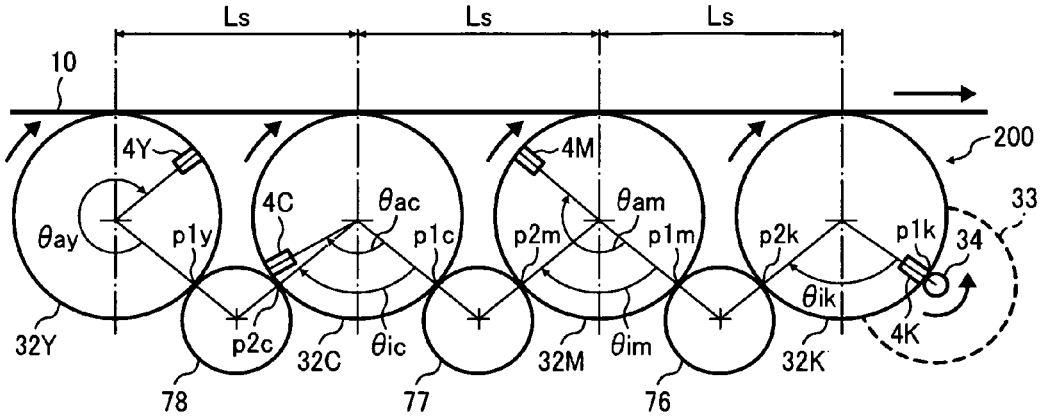
FIG. 5 is a schematic view illustrating an example of arrangement of drive gears in the drive device according to a first illustrative embodiment.

FIG. 5 is a schematic view illustrating an example of arrangement of the drive gears 32 in the drive device 200 according to the first illustrative embodiment. A point where the drive gear 32K and the motor gear 34 engage each other is hereinafter referred to as an engagement point pk1. A point where the drive gear 32K and the first idler gear 76 engage each other is hereinafter referred to as an engagement point p2*k*. A central angle between the engagement points p1*k* and p2*k* in a direction of rotation of the drive gear 32K is hereinafter referred to as a setting angle θik. Similarly, a point where the drive gear 32M and the first idler gear 76 engage each other is hereinafter referred to as an engagement point p1*m*. A point where the drive gear 32M and the second idler gear 77 engage each other is hereinafter referred to as an engagement point p2*m*. A central angle between the engagement points p1*m* and p2*m* in a direction of rotation of the drive gear 32M is hereinafter referred to as a setting angle elm. A point where the drive gear 32C and the second idler gear 77 engage each other is hereinafter referred to as an engagement point p1*c*. A point where the drive gear 32*c* and the third idler gear 78 engage each other is hereinafter referred to as an engagement point p2*c*. A central angle between the engagement points p1*c* and p2*c* is hereinafter referred to as a setting angle θic. A point where the drive gear 32Y and the third idler gear 78 engage each other is hereinafter referred to as an engagement point p1*y*.

In the first illustrative embodiment, the drive gears 32 and the first, second, and third idler gears 76, 77, and 78 are positioned such that the setting angles θik, θim, and θic are the same. Here, the optimal degree of the setting angles θik, θim, and θic is obtained from the diameter D of each of the photoconductors 2 and the distance Ls between the rotary shafts of each of the two adjacent photoconductors 2 described detail below.

First, an optimal phase difference in rotary speed fluctuation between each of the two adjacent photoconductors 2 that can compensate color shift generated by a shift in amplitude and phase in the rotary speed fluctuation between the two adjacent photoconductors 2 is obtained. It is to be noted that each of the photoconductors 2 has the same diameter D, the distance Ls between each of the two adjacent photoconductors 2 is the same, and a linear speed of the intermediate transfer belt 10 is substantially the same as a linear speed of each of the photoconductors 2. The optimal phase difference can be expressed by a rotational angle (hereinafter referred to as an optimal phase difference angle ϕ) used when a phase of rotary speed fluctuation in one of the two adjacent photoconductors 2 provided upstream from the other one of the photoconductors 2 in a direction of rotation of the intermediate transfer belt 10 is shifted to a direction opposite a direction of rotation of each of the photoconductors 2 from a phase of rotary speed fluctuation in the other one of the photoconductors 2 provided downstream from the one of the photoconductors 2 in the direction of rotation of the intermediate transfer belt 10. Accordingly, the same point on the intermediate transfer belt 10 which has passed a transfer position TP on the one of the photoconductors 2 provided upstream from the other one of the photoconductors 2 in the direction of rotation of the intermediate transfer belt 10 when the one of the photoconductors 2 has been rotated at the maximum rotary speed passes a transfer position TP on the other one of the photoconductors 2 provided downstream from the one of the photoconductors 2 in the direction of rotation of the intermediate transfer belt 10 when the other one of the photoconductors 2 is rotated at the maximum rotary speed. Therefore, the optimal phase difference angle cp is calculated by Formula 1 below, where Ld is a running distance of the surface of each of the photoconductors 2 while each of the drive gears 32 makes a single rotation, Ls is the distance between the rotary shafts of each of the two adjacent photoconductors 2, and u (an integer) is the number of rotations made by each of the drive gears 32 while the intermediate transfer belt 10 is moved by the distance Ls. In addition, that which is expressed by Formula 1 can also be expressed by Formula 2 below using the diameter D of each of the photoconductors 2 in a case in which each of the drive gears 32 is provided coaxially to each of the photoconductors 2 and each of the photoconductors 2 makes a single rotation while the intermediate transfer belt 10 is moved by the distance Ls.

$$\phi = 2\pi\frac{(Ls - uLd)}{Ld} \quad \text{[Formula 1]}$$

$$\phi = 2\frac{(Ls - \pi D)}{D} \quad \text{[Formula 2]}$$

In the first illustrative embodiment, the drive gears 32 are provided coaxially to the photoconductors 2, respectively. Thus, a single rotation of each of the drive gears 32 corresponds to a single rotation of each of the photoconductorg 2. In such a case, relations of the optimal setting angles θik, θim, and θic in the respective drive gears 32 can be expressed by Formula 3 below using the optimal phase difference angle ϕ when an amount of acceptable error is not considered.

$$\theta = \theta ik = \theta im = \theta ic = \pi - \phi \quad \text{[Formula 3]}$$

Arrangement of each of the motor gear 34 and the idler gears 76, 77, and 78 is determined such that the setting angles θik, θim, and θic have the optimal values obtained by Formula 3. Then, a diameter and the number of teeth of each of the drive gears 32 and the idler gears 76, 77, and 78 are selected to enable the gears to appropriately engage each other.

At this time, it may be set such that each of the surfaces of the photoconductors 2 is rotated by a rotational angle R between a writing position SP where the electrostatic latent image is written and the transfer position TP while each of the motor gear 34 and the idler gears 76, 77, and 78 makes an integer number of rotations. As a result, elongation or contraction of the resultant image caused by rotary speed fluctuation in the photoconductors 2 due to eccentricity of the motor gear 34 and the idler gears 76, 77, and 78 can be prevented.

Next, a rotational position of each of the drive gears 32 arranged as described above is adjusted such that predetermined relative eccentric phases of the drive gears 32 described below is achieved.

Here, rotational angles for moving the points of maximum eccentricity in the drive gears 32, that is, points where the marks 4 are positioned, from the engagement points plk, plm, plc, and ply of the drive gears 32 serving as an input gear to respective target adjustment points in the direction of rotation of the drive gears 32 are referred to as phase difference adjustment angles θak, θam, θac, and θay. Each of the phase difference adjustment angles θak, θam, θac, and θay is expressed by Formula 4 below using the optimal phase difference angle ϕ.

$$\theta ak = 0$$

$$\theta am = \theta i + \phi = \pi$$

$$\theta ac=2\phi$$

$$\theta ay=\theta i+3\phi=\pi+2\phi \quad \text{[Formula 4]}$$

Thus, the drive gears 32 are mounted such that the rotational positions of the marks 4 in the drive gears 32 correspond to the respective target adjustment points, that is, positions obtained by rotating the marks 4 from the engagement points p1*k*, p1*m*, p1*c*, and ply of the drive gears 32 by the phase difference adjustment angles θak, θam, θac, and θay in the direction of rotation of the drive gears 32, respectively. As a result, the drive gears 32 have the predetermined relative eccentric phases that can prevent color shift caused by a shift in amplitudes and phases of the rotary speed fluctuation in each of the photoconductors 2 due to eccentricity of the drive gears 32.

It is to be noted that, although the phase difference adjustment angles θak is set to zero as a matter of convenience in the above example, a value of the phase difference adjustment angles θak may be added to each of the phase difference adjustment angles θam, θac, and θay in a case in which the phase difference adjustment angles θak is not zero.

A description is now given of effectiveness of the above-described method for mounting the drive gears 32 in preventing color shift caused by a shift in amplitudes and phases of the rotary speed fluctuation in each of the photoconductors 2 due to eccentricity of the drive gears 32.

Rotary speed fluctuation due to eccentricity of the drive gear 32K occurs at the engagement point p1*k* between the drive gear 32K and the motor gear 34. Rotary speed fluctuation due to eccentricity of a gear can be expressed by a sine function, and rotary speed fluctuation Vk in the drive gear 32K is expressed by Formula 5 below, where an amplitude is set to 1 as a matter of convenience and θ is a rotational angle of the mark 4K of the drive gear 32K from the engagement point p1*k*.

$$VK=\sin(\theta) \quad \text{[Fomrula 5]}$$

The drive gear 32M corresponding to the photoconductor 2M provided upstream from the photoconductor 2K in the direction of rotation of the intermediate transfer belt 10 is mounted such that an eccentricity phase difference between the drive gears 32M and 32K is set to the optimal phase difference angle ϕ in the method described above according to the first illustrative embodiment. Therefore, target rotary speed fluctuation Vm_ref of the drive gear 32M is expressed by Formula 6 below. It is to be noted that a rotational angle (θ+ϕ) of the drive gear 32M is a rotational angle of the mark 4M of the drive gear 32M from the engagement point p1*m*. Similarly, target rotary speed fluctuation Vc_ref of the drive gear 32C and target rotary speed fluctuation Vy_ref of the drive gear 32Y are expressed by Formulae 7 and 8 below, respectively.

$$Vm_ref=\sin(\theta+\phi) \quad \text{[Formula 6]}$$

$$Vc_ref=\sin(\theta+2\phi) \quad \text{[Formula 7]}$$

$$Vy_ref=\sin(\theta+3\phi) \quad \text{[Formula 8]}$$

In practice, rotary speed fluctuation in the drive gear 32K occurs in the following sequence. First, the rotary speed fluctuation expressed by Formula 5 above is generated in the drive gear 32K at the engagement point p1*k* between the drive gear 32K and the motor gear 34 due to eccentricity of the drive gear 32K. At the engagement point p2K between the drive gear 32K and the first idler gear 76 provided at a rotational position away from the engagement point p1K by the setting angle θi in the direction of rotation of the drive gear 32K, the drive gear 32K having the above-described rotary speed fluctuation transmits its own torque to the first idler gear 76. As a result, rotary speed fluctuation delayed by the setting angle θi from the rotary speed fluctuation expressed by Formula 5 is generated in the first idler gear 76 at the engagement point p2*k* due to eccentricity of the drive gear 32K.

Further, the first idler gear 76 transmits its own torque to the drive gear 32M at the engagement point p1*m* between the first idler gear 76 and the drive gear 32M, that is, a rotational position away from the engagement point p2*k* by the setting angle θi in the direction of rotation of the first idler gear 76. At the engagement point p1*m*, rotary speed fluctuation is generated in the drive gear 32M due to its own eccentricity.

The drive gear 32M is rotatively driven with a cumulative amount of the above-described rotary speed fluctuation. Therefore, rotary speed fluctuation Vm in the drive gear 32M having rotational frequency of the drive gears 32K and 32M is expressed by Formula 9 below.

$$Vm=\sin(\theta)-\sin(\theta-\theta i)+\sin(\theta+\theta i+\phi) \quad \text{[Formula 9]}$$

Thus, torque that rotates the drive gear 32M is transmitted from the drive motor 33 to the drive gear 32M through the engagement points p1*k*, p2*k*, and p1*m*. Consequently, transmission error generated at each of the engagement points p1*k*, p2*k*, and p1*m* is superimposed to cause rotary speed fluctuation expressed by Formula 9 above in the drive gear 32M.

In the first illustrative embodiment, the drive gears 32 and the idler gears 76, 77, and 78 are mounted such that the setting angle θi is set to "π−ϕ" as shown above in Formula 3. In addition, the drive gear 32M is mounted at an adjustment point in which the eccentric phase of the drive gear 32M is rotated by "ϕi+ϕ=π" relative to the eccentric phase of the drive gear 32K. Accordingly, a difference in the eccentric phases between the drive gears 32M and 32K is π, that is, 180°, thereby compensating transmission error occurred at the engagement point p1K due to eccentricity of the drive gear 32K and transmission error occurred at the engagement point p1*m* due to eccentricity of the drive gear 32M. Because transmission error occurred at the two engagement points p1*k* and p1*m* is compensated as described above and the setting angle θi is set to "π−ϕ", the remaining transmission error occurred at the engagement point p2K due to eccentricity of the drive gear 32K is equal to target rotary speed fluctuation (or target transmission error). Formula 10 below is obtained by substituting "π−ϕ" shown above in Formula 3 into the setting angle ei shown in Formula 9.

$$Vm=\sin(\theta)-\sin(\theta-\pi+\phi)+\sin(\theta+\pi-\phi+\phi)=\sin(\theta+\phi) \quad \text{[Formula 10]}$$

As a result, it was confirmed that the rotary speed fluctuation Vm in the drive gear 32M is equal to the target rotary speed fluctuation Vm_ref shown above in Formula 6 in the method for mounting the drive gears 32 according to the first illustrative embodiment in which the setting angle ei is set to "π−ϕ" shown above in Formula 3.

Rotary speed fluctuation Vc in the drive gear 32C is obtained in a manner similar to the rotary speed fluctuation Vm described above, and Formula 11 below is obtained by substituting "π−ϕ" shown above in Formula 3 into the setting angle ei shown in Formula 9. In addition, rotary speed fluctuation Vy in the drive gear 32Y is obtained in a manner similar to the rotary speed fluctuation Vm described above, and Formula 12 below is obtained by substituting "π−ϕ" shown above in Formula 3 into the setting angle Gi shown in Formula 9. It was found that the rotary speed fluctuations Vc and Vy are equal to target rotary speed fluctuations Vc_ref and Vy_ref shown above in Formulae 7 and 8, respectively.

$$Vc=\sin(\theta)-\sin(\theta-\theta i)+\sin(\theta+\theta i+\phi)-\sin(\theta+\phi)+\sin(\theta+2\phi)=\sin(\theta+2\phi) \quad \text{[Formula 11]}$$

$$Vy=\sin(\theta)-\sin(\theta-\theta i)+\sin(\theta+\theta i+\phi)-\sin(\theta+\phi)+\sin(\theta+2\phi)-\sin(\theta-\theta i+2\phi)+\sin(\theta+\theta i+3\phi)=\sin(\theta+3\phi) \quad \text{[Formula 12]}$$

In the method for mounting the drive gears 32 according to the first illustrative embodiment, amplitude of rotary speed fluctuation due to eccentricity of each of the drive gears 32 that drives the respective photoconductors 2 is set to 1. Further, it is clear from Formulae 10 to 12 above that the phase difference in rotary speed fluctuation between each of two adjacent drive gears 32 is set to the optimal phase difference angle ϕ so as to prevent color shift caused by a shift in amplitudes and phases of rotary speed fluctuation in each of the photoconductors 2 due to eccentricity of the drive gears 32.

Accordingly, amplitudes and phases of rotary speed fluctuation in all of the photoconductors 2 caused by eccentricity of the drive gears 32 coincide with one another, respectively, when the same point on the intermediate transfer belt 10 passes each of the transfer positions TP on the surfaces of the photoconductors 2. As a result, color shift caused by eccentricity of the drive gears 32 can be prevented.

A description is now given of the first illustrative embodiment of the present invention.

In the first illustrative embodiment, each of the photoconductors 2 has the diameter D of 30 mm and a circumference Ld of 94.25 mm. The distance Ls between the rotary shafts of each of the two adjacent photoconductors 2 is set to 100 mm. Torque input from the motor gear 33 is reduced at one-step by the drive gear 32K to rotatively drive the photoconductors 2.

The optimal phase difference angle ϕ in the first illustrative embodiment is 0.38 rad)(22° in accordance with Formula 2, and the setting angle θi is 2.76 rad)(158°) in accordance with Formula 3. Based on these results, first, the number of teeth of each of the drive gears 32 and the idler gears 76, 77, and 78 is selected to have the setting angle θi of 158°. At this time, the number of teeth of each of the gears is selected based on conditions in which a rotational angle R between the writing position SP and the transfer position TP on each of the photoconductors 2 is set to 147°, and each of the idler gears 76, 77, and 78 and the motor gear 34 makes the integer number of rotations while each of the photoconductors 2 is rotated by the rotational angle R of 147°. As a result, a shape of each of the drive gears 32, the idler gears 76, 77, and 78, and the motor gear 34 is selected as shown in Table 1 below.

TABLE 1

| | Number of Teeth | Module | Diameter (mm) |
|---|---|---|---|
| Drive Gear | 300 | 0.3 | 90 |
| Idler Gear | 39 | 0.3 | 11.7 |
| Motor Gear | 15 | 0.3 | 4.5 |

Accordingly, the setting angle θi is set to 159°. The motor gear 34 for the drive motor 33 is provided such that all of the setting angles have the same value θi. In addition, the motor gear 34 makes 8.2 rotations and each of the idler gears 76, 77, and 78 makes 3.1 rotations, respectively, while each of the photoconductors 2 is rotated by the rotational angle R of 147° from the writing position SP to the transfer position TP. Thus, each of the idler gears 76, 77, and 78 and the motor gear 34 is set to substantially make the integer number of rotations while each of the photoconductors 2 is rotated by the rotational angle R of 147°. It is to be noted that an acceptable amount of difference from the integer number of rotations is determined based on an acceptable amount of color shift caused by eccentricity of each of the motor gear 34 and the idler gears 76, 77, and 78.

Further, the phase difference adjustment angles θak, θam, θac, and θay in the respective drive gears 32 are set to 0°, 180°, 44°, and 224°, respectively, in accordance with Formula 4.

Effectiveness achieved by the first illustrative embodiment is described in detail below.

Figure 6:
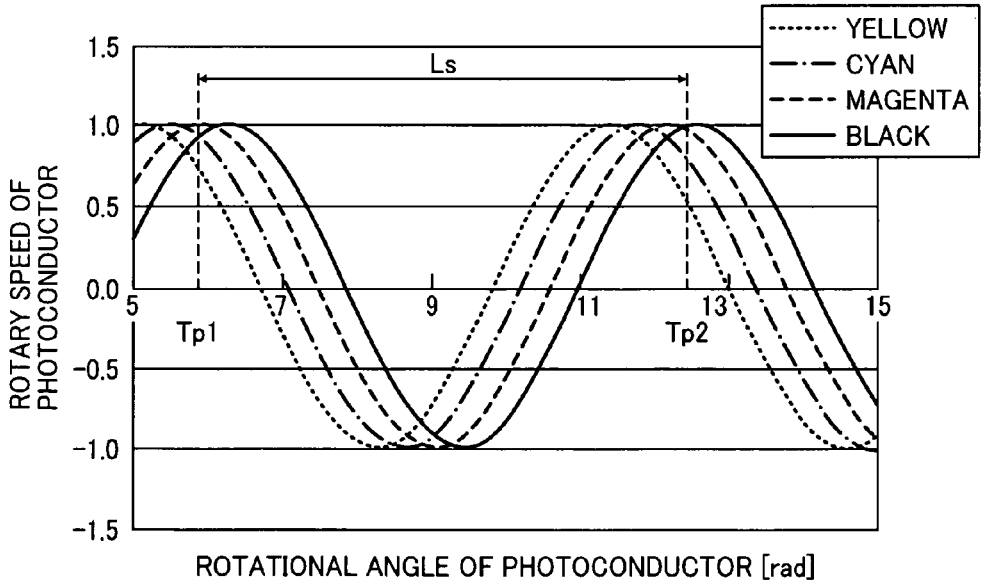
FIG. 6 is a graph showing ideal relative rotary speed fluctuations in photoconductors.

FIG. 6 is a graph showing ideal relative rotary speed fluctuations in the photoconductors 2 that prevents color shift. In the graph shown in FIG. 6, a horizontal axis represents a rotational angle (radian) of the photoconductor 2K, and a vertical axis represents a rotary speed of each of the photoconductors 2 (the maximum rotary speed (amplitude) is 1). It is to be noted that the rotational angle shown in the horizontal axis in FIG. 6 can be converted into time. Ideal rotary speed fluctuation in each of the photoconductors 2 is that, using the photoconductor 2K as a reference, the photoconductors 2M, 2C, and 2Y has the same amplitude and a waveform having a phase led by the optimal phase difference angle ϕ (22°) relative to rotary speed fluctuation in the adjacent photoconductor 2 provided upstream from the corresponding photoconductor 2 in the direction of rotation of the intermediate transfer belt 10. For example, a magenta toner image transferred from the surface of the photoconductor 2M onto the intermediate transfer belt 10 when the rotational angle of the photoconductor 2K is Tp1 is then moved by the distance Ls (100 mm) as the intermediate transfer belt 10 is rotated to reach the transfer position TP of the photoconductor 2K so that a black toner image is transferred from the photoconductor 2K and is superimposed on the magenta toner image on the intermediate transfer belt 10. The circumference Ld of each of the photoconductors 2 is 94.25 mm as described previously so that a rotational angle Tp2 of the photoconductor 2K at this time is equal to an angle rotated by 360° plus 22° from the rotational angle Tp1. Accordingly, the magenta toner image and the black toner image superimposed one atop the other are transferred onto the intermediate transfer belt 10 when the photoconductors 2M and 2K are rotated at the same rotary speed, respectively. Similarly, electrostatic latent images of the magenta toner image and the black toner image are written on the surfaces of the photoconductors 2M and 2K at the respective writing positions SP when the photoconductors 2M and 2K are rotated at the same rotary speed, respectively. As a result, color shift does not occur between the magenta and black toner images superimposed one atop the other. Similarly, color shift does not occur among the toner images of the rest of the colors.

Figure 7:
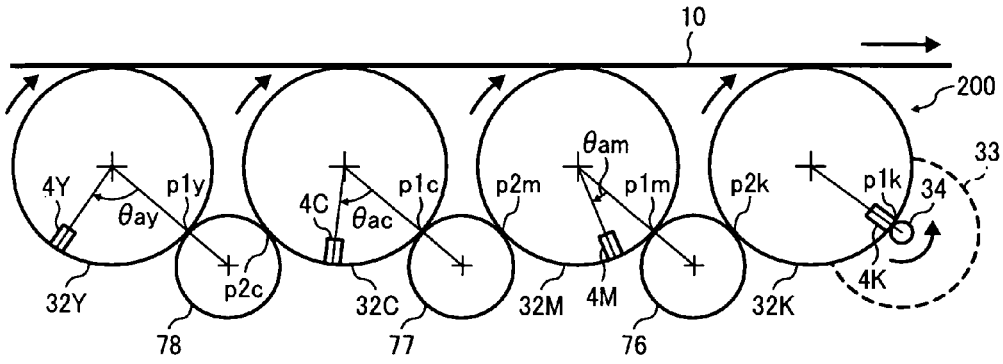
FIG. 7 is a schematic view illustrating arrangement of the drive gears in the drive device according to a comparative example of the first illustrative embodiment.
Figure 8:
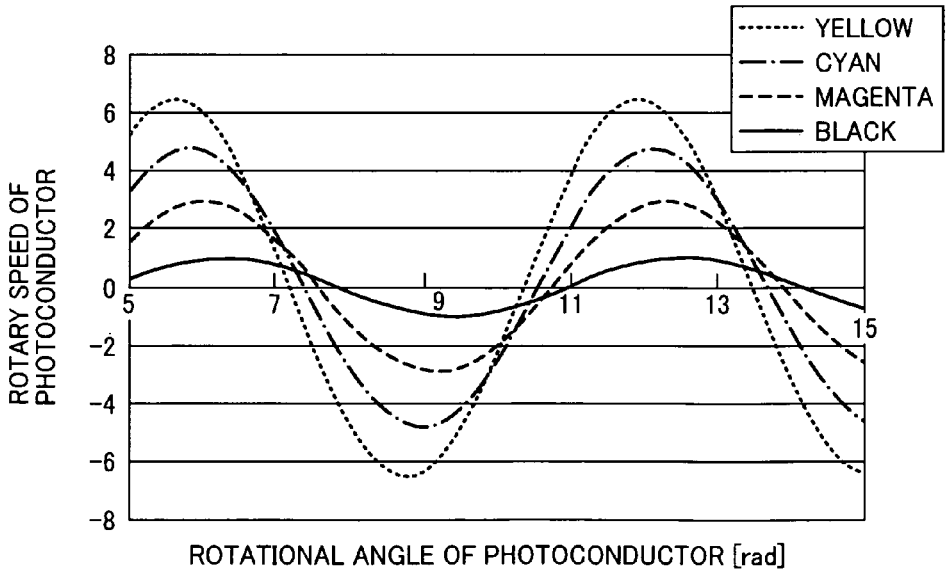
FIG. 8 is a graph showing relative rotary speed fluctuations in the photoconductors according to the comparative example of the first illustrative embodiment.

A description is now given of a case in which a method for mounting the drive gears 32 according to a comparative example of the first illustrative embodiment is employed. FIG. 7 is a schematic view illustrating arrangement of the drive gears 32 in the drive device 200 according to the comparative example of the first illustrative embodiment. FIG. 8 is a graph showing relative rotary speed fluctuations in the photoconductors 2 according to the comparative example of the first illustrative embodiment.

In the comparative example, the phase difference adjustment angle θam of the drive gear 32M is set to 22°, the phase difference adjustment angle θac of the drive gear 32C is set to 44°, and the phase difference adjustment angle θay of the drive gear 32Y is set to 66°, respectively, upon mounting of the drive gears 32. Consequently, resultant relative rotary speed fluctuations shown in FIG. 8 considerably differ from the ideal relative rotary speed fluctuations shown in FIG. 6, thereby causing a large amount of color shift.

In particular, in the comparative example, rotary sped fluctuations in the photoconductors 2M, 2C, and 2Y are sequentially increased relative to rotary speed fluctuation in the photoconductor 2K because of the following reasons.

As described previously, not only rotary speed fluctuation caused by eccentricity of the corresponding drive gears 32 but also rotary speed fluctuation caused by eccentricity of the drive gears 32 provided upstream from the corresponding drive gears 32 in the direction of transmission of torque cause rotary speed fluctuation in the photoconductor 2 provided downstream from the rest of the photoconductors 2 in the direction of transmission of torque. Consequently, when the drive gears 32 are mounted with near phases like that in the comparative example, the cumulative rotary speed fluctuation in the photoconductor 2 provided downstream from the rest of the photoconductors 2 in the direction of transmission of torque further increases, causing a large amount of color shift.

Figure 9:
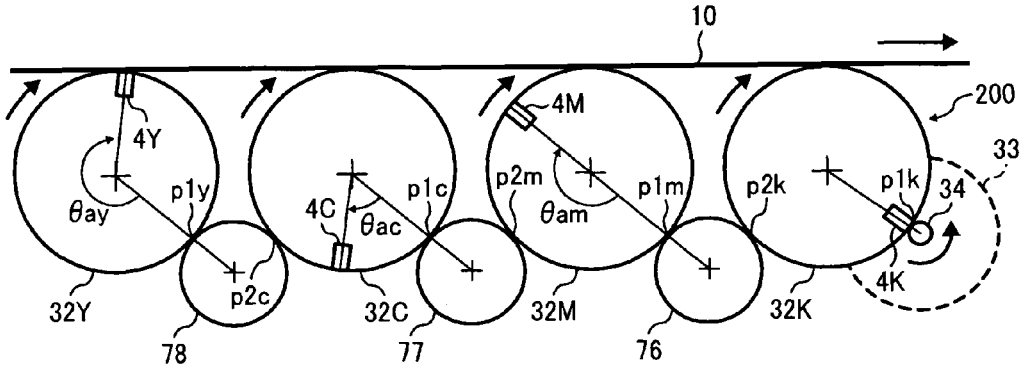
FIG. 9 is a schematic view illustrating an example of arrangement of the drive gears in the drive device according to the first illustrative embodiment.
Figure 10:
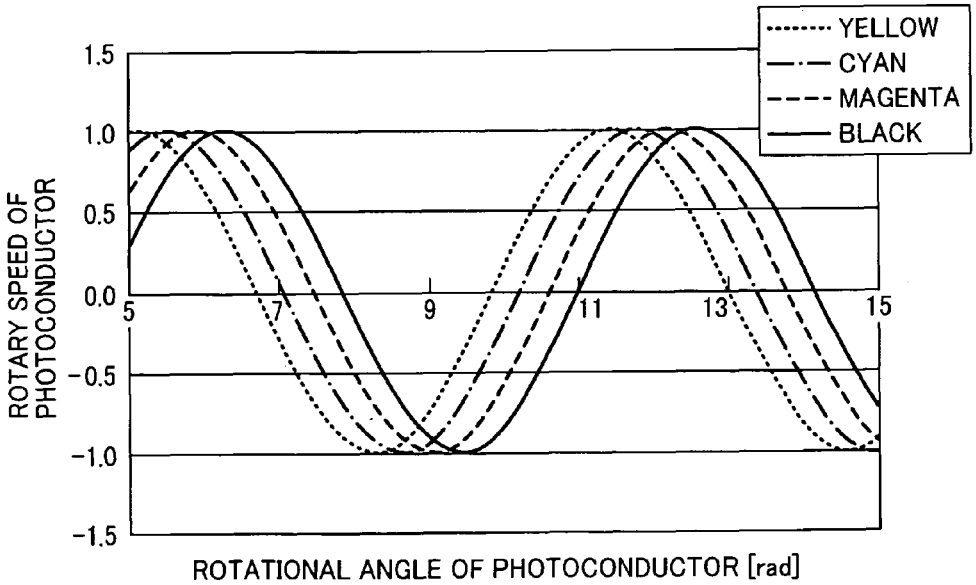
FIG. 10 is a graph showing relative rotary speed fluctuations in the photoconductors according to the first illustrative embodiment.

FIG. 9 is a schematic view illustrating an example of arrangement of the drive gears 32 in the drive device 200 according to the first illustrative embodiment. FIG. 10 is a graph showing relative rotary speed fluctuations in the photoconductors 2 according to the first illustrative embodiment.

In a case in which the method for mounting the drive gears 32 according to the first illustrative embodiment is employed, the phase difference adjustment angle earn in the drive gear 32M is set to 180°, the phase difference adjustment angle θac in the drive gear 32C is set to 44°, and the phase difference adjustment angle θay of the drive gear 32Y is set to 224°, respectively, upon mounting of the drive gears 32 when the phase difference adjustment angle θak of the drive gear 32K is set to 0°. As a result, as shown in FIG. 10, relative rotary speed fluctuations in the photoconductors 2 coincide with the ideal relative rotary speed fluctuations shown in FIG. 6, thereby preventing color shift.

Importance of the setting angle θi and an acceptable amount of design error is described below.

In the first illustrative embodiment, the above-described design of the gear array that achieves the setting angle θi and mounting of the drive gears 32 with the above-described phase difference adjustment angles θak, θam, θac, and θay can prevent color shift. Although the ideal setting angle θi is 158°, the setting angle θi in the first illustrative embodiment is set to 159° under design in consideration of shapes of the drive gears 32. The above difference of 1° in the setting angle θi from the ideal setting angle θi of 158° does not cause color shift. However, a larger difference in the setting angle θi from the ideal angle θi causes an unacceptable amount of color shift.

Figure 11:
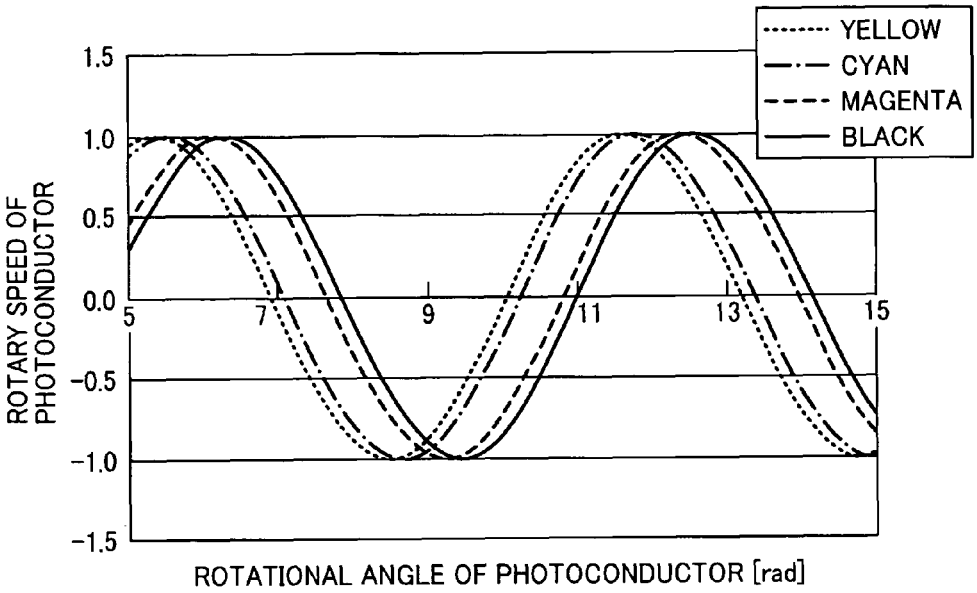
FIG. 11 is a graph showing relative rotary speed fluctuations in the photoconductors when a setting angle $\theta i$ is set to 170°.

FIG. 11 is a graph showing relative rotary speed fluctuations in the photoconductors 2 when the setting angle θi is set to 170° in the first illustrative embodiment. In such a case, although rotary speed fluctuation in each of the photoconductors 2 has the same amplitude, relative phases of the rotary speed fluctuations in each of the photoconductors 2 are offset from the ideal relative phases shown in FIG. 6 due to a difference of 12° in the setting angle θi from the ideal value. Consequently, color shift occurs with an error rate of 20%. Here, the error rate of 20% means that color shift of 20 μm occurs when a drive gear that may cause a shift in a transfer position of up to 100 μm on the resultant image is used.

Figure 12:
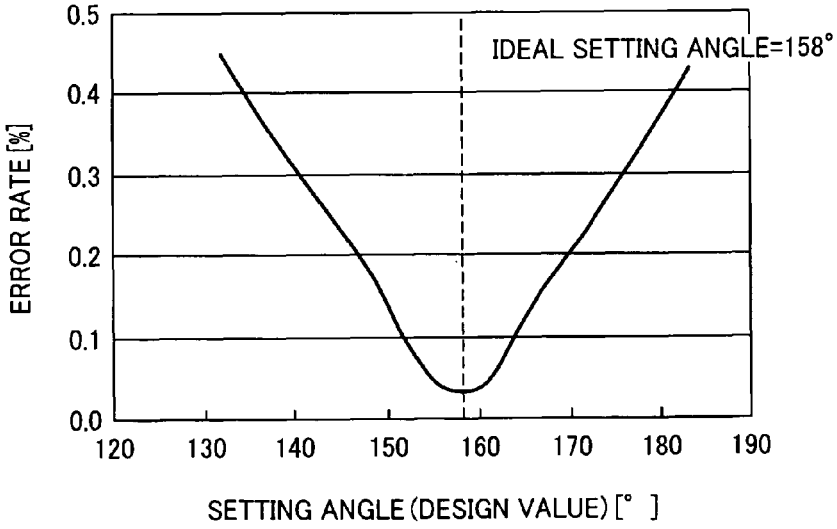
FIG. 12 is a graph showing a relation between the setting angle $\theta i$ and an error rate according to the first illustrative embodiment.

FIG. 12 is a graph showing a relation between the setting angle θi and the error rate according to the first illustrative embodiment.

In practice, the error rate must be suppressed under 30% because of mounting error and manufacturing error during manufacturing of the drive gears 32. Therefore, based on the graph shown in FIG. 12, it is desired that an acceptable error e of the setting angle θi be set within ±20° from the ideal setting angle θi.

A description is now given of a second illustrative embodiment of the present invention. Because the basic configuration of the image forming apparatus 100 according to the second illustrative is substantially the same as that of the first illustrative embodiment, only the differences from the first illustrative embodiment is described in detail below.

Figure 13:
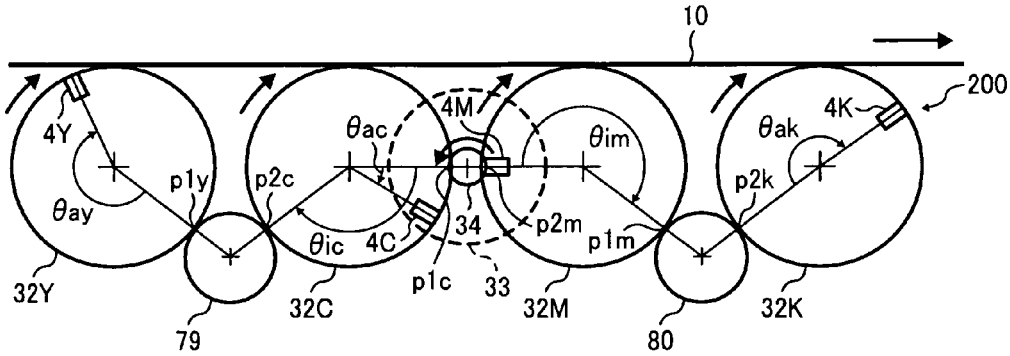
FIG. 13 is a schematic view illustrating an example of arrangement of the drive gears in the drive device according to a second illustrative embodiment.

FIG. 13 is a schematic view illustrating an example of arrangement of the drive gears 32 in the drive device 200 according to the second illustrative embodiment.

In the second illustrative embodiment, the drive motor 33 is positioned between the drive gears 32M and 32C. Therefore, the motor gear 34 engages both the drive gears 32M and 32C to transmit torque to both the drive gears 32M and 32C. Compared to the arrangement of the drive gears 32 in the first illustrative embodiment, load torque applied to the motor gear 34 and the drive gears 32M and 32C provided on the extreme upstream side in the direction of transmission of torque (each of which corresponds to the drive gear 32K in the first illustrative embodiment) is reduced, thereby improving durability.

Similar to the first illustrative embodiment, a torque transmission path from the drive motor 33 to the drive gear 32Y through the drive gear 32C is opposite the direction of rotation of the intermediate transfer belt 10. In such a case, the drive gear 32C serves as the first drive gear and the drive gear 32Y serves as the second drive gear to use a method for mounting the drive gears 32 similar to that according to the first illustrative embodiment. Thus, the optimal phase difference angle ϕ is set to 0.38 rad (22°) in accordance with Formula 2, and the setting angle θi is set to 2.76 rad (158°) in accordance with Formula 3. Based on these results, the number of teeth of each of the drive gears 32C and 32Y and a first idler gear 79 that achieves the setting angle θi of 158° is selected. Although the phase difference adjustment angles θac and θay which are supposed to be set in accordance with Formula 4 are 0° and 180°, respectively, because the phase difference adjustment angles θam is set to 0° in the second illustrative embodiment, the phase difference adjustment angle θac is set to 22°, and the phase difference adjustment angle θay is set to 202°, in which 22° is added to 180°.

Differing from the first illustrative embodiment, the direction of transmission of torque from the drive motor 33 to the drive gear 32K through the drive gear 32M is the same as the direction of rotation of the intermediate transfer belt 10 in the second illustrative embodiment. In such a case, the optimal phase difference angle ϕ, that is, a phase difference of the drive gear 32K from the drive gear 32M in the direction of rotation of the drive gears 32 is expressed by Formula 13 below.

$$\phi = -2\pi\frac{(Ls - uLd)}{Ld} \qquad \text{[Formula 13]}$$

Accordingly, the optimal phase difference angle ϕ along a torque transmission path from the drive gear 32M to the drive gear 32K is set to −0.38 rad (−22°) in accordance with Formula 13. In addition, the setting angle θi of 3.53 rad (202°) is obtained in accordance with Formula 3. Based on these results, the number of teeth in each of the drive gears 32M and 32K and a second idler gear 80 that achieves the setting angle θi of 202° is selected, respectively. At this time, when the same number of teeth is set for each of the drive gears 32 and the first and second idler gears 79 and 80 along the torque transmission paths provided both upstream and downstream from the drive motor 33 in the direction of rotation of the intermediate transfer belt 10, it is preferable to set a portion where the drive motor 33 and the motor gear 34 engage each other positions on a virtual line from the center of rotation of the drive gear 32C to the center of rotation of the drive gear 32M as shown in FIG. 13. In accordance with Formula 4, the phase difference adjustment angle θam and θak are set to 0° and 180°, respectively.

Similar to the first illustrative embodiment, the above-described method for mounting the drive gears 32 according to the second illustrative embodiment can achieve higher quality image without color shift caused by eccentricity of the drive gears 32.

A description is now given of a third illustrative embodiment of the present invention. Because the basic configuration of the image forming apparatus 100 according to the third illustrative is substantially the same as that of the first illustrative embodiment, only the differences from the first illustrative embodiment is described in detail below.

Figure 14:
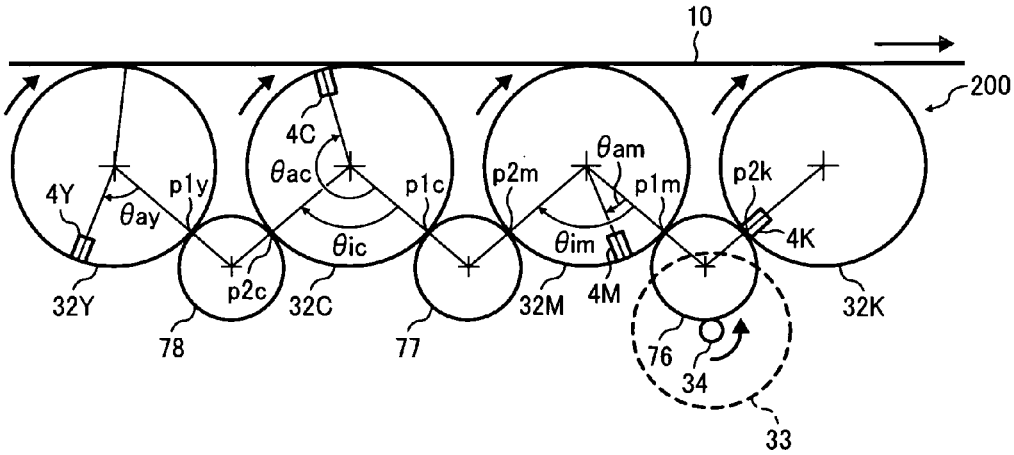
FIG. 14 is a schematic view illustrating an example of arrangement of the drive gears in the drive device according to a third illustrative embodiment.

FIG. 14 is a schematic view illustrating an example of arrangement of the drive gears 32 in the drive device 200 according to the third illustrative embodiment.

In the third illustrative embodiment, the drive motor 33 is provided between the drive gears 32M and 32K, and the motor gear 34 engages the first idler gear 76 that engages both the drive gears 32M and 32K. Accordingly, torque from the drive motor 33 is bifurcated by the first idler gear 76, and then is transmitted to both the drive gears 32M and 32K.

Similar to the first illustrative embodiment, the direction of transmission of torque from the drive motor 33 to the drive gears 32M, 32C, and 32Y through the first idler gear 76, the second idler gear 77, and the third idler gear 78 is opposite the direction of rotation of the intermediate transfer belt 10. In such a case, the first idler gear 76 serves as an input gear, the drive gear 32M serves as the first drive gear, the drive gear 32C serves as the second drive gear, and the drive gear 32Y serves as the third drive gear to use the method for mounting the drive gears 32 similar to that of the first illustrative embodiment. Thus, the optimal phase difference angle ϕ is set to 0.38 rad (22°) in accordance with Formula 2, and the setting angle θi is set to 2.76 rad (158°) in accordance with Formula 3. Based on these results, the number of teeth of each of the drive gears 32M, 32C, and 32Y, the first idler gear 76, the second idler gear 77, and the third idler gear 78 that achieves the setting angle θi of 158° is selected, respectively. Although the phase difference adjustment angles θam, θac, and θay are supposed to be set to 0°, 180°, and 44°, respectively, in accordance with Formula 4, because the phase difference adjustment angle θak is set to 0° in the third illustrative embodiment, the phase difference adjustment angle θam is set to 22°, the phase difference adjustment angle θac is set to 202°, in which 22° is added to 180°, and the phase difference adjustment angle θay is set to 66°, in which 22° is added to 44°.

Similar to the first and second illustrative embodiments, the above-described method for mounting the drive gears 32 according to the third illustrative embodiment can achieve higher quality image without color shift caused by eccentricity of the drive gears 32.

The image forming apparatus 100 according to the foregoing illustrative embodiments includes the drive device 200 including the single drive motor 33 that generates torque to be transmitted to the N number of photoconductors 2 arranged side by side in the direction of rotation of the intermediate transfer belt 10, where N is a positive integer equal to or greater than 2. The drive device 200 further includes the N number of drive gears 32 that transmit torque from the drive motor 33 to the N number of photoconductors 2, respectively, and the input gear (e.g., the motor gear 34 in the first and second illustrative embodiments and the first idler gear 76 in the third illustrative embodiment) rotatively driven by torque from the drive motor 33. The input gear engages the first drive gear among the N number of drive gears 32 (e.g., the drive gear 32K in the first illustrative embodiment, the drive gears 32M and 32C in the second illustrative embodiment, and the drive gear 32M in the third illustrative embodiment). Thus, torque is transmitted from the drive motor 33 to the first drive gear through the input gear. The first drive gear transmits torque to the first photoconductor among the N number of photoconductors 2 (e.g., the photoconductor 2K in the first illustrative embodiment, the photoconductors 2M and 2C in the second illustrative embodiment, and the photoconductor 2M in the third illustrative embodiment). The drive device 200 further includes the N−1 number of idler gears (e.g., the idler gears 76, 77, and 78 in the first illustrative embodiment, the idler gears 79 and 80 in the second illustrative embodiment, and the idler gears 77 and 78 in the third illustrative embodiment) provided between each of the N number of drive gears 32, respectively, to transmit torque from the drive gears 32 provided on the upstream side in the direction of transmission of torque to the drive gears 32 provided on the downstream side in the direction of transmission of torque. Therefore, torque generated by the drive motor 33 is sequentially transmitted from the first drive gear to the Nth drive gear through the N−1 number of idler gears to rotatively drive the N number of photoconductors 2. Toner images respectively formed on the surfaces of the N number of photoconductors 2 rotatively driven by the drive device 200 are sequentially transferred onto the intermediate transfer belt 10 such that the toner images are superimposed one atop the other on the intermediate transfer belt 10 to form a full-color toner image.

Each of the N number of drive gears 32 has substantially the same amount of eccentricity. The input gear, the N number of drive gears 32, and the N−1 number of idler gears are arranged to cause the setting angle (e.g., θik in the first illustrative embodiment, θim and θic in the second illustrative embodiment, and θim in the third illustrative embodiment) between the engagement point (e.g., the engagement point p1*k* in the first illustrative embodiment, the engagement points p2*m* and p1*c* in the second illustrative embodiment, and the engagement point p1*m* in the third illustrative embodiment) where the input gear and the first drive gear engage each other and the engagement point where a first idler gear included in the N−1 number of idler gears (e.g., the first idler gear 76 in the first illustrative embodiment, the first and second idler gears 79 and 80 in the second illustrative embodiment, and the second idler gear 77 in the third illustrative embodiment) engages the first drive gear to be set to θi obtained by Formula $\theta i=\pi-\phi\pm e$, where e is an amount of acceptable amount of error. In addition, the setting angle (e.g., θim and θic in the first illustrative embodiment and θic in the third illustrative embodiment) between the engagement point where the (n−1)th idler gear included in the N−1 number of idler gears, where n is a positive integer between 2 and (N−1), and the nth drive gear included in the N number of drive gears 32 engage each other and the engagement point where the nth idler gear included in the N−1 number of idler gears and the nth drive gear engage each other is also set to θi obtained by Formula $\theta i=\pi-\phi\pm e$, where e is an amount of acceptable error. The N number of drive gears 32 are mounted to offset a rotational position of the point of maximum eccentricity in the nth drive gear (that is, the position where the mark 4 is provided) from a rotational position of the point of maximum eccentricity in the first drive gear in a direction of rotation of the nth drive gear by an angle θan obtained by Formula $\theta an=(n-1)\phi$ when n is an odd integer, and by an angle $\theta an$ obtained by Formula $\theta an=\theta i+(n-1)\phi$ when n is an even integer. Accordingly, the N−1 number of drive gears 32 are used not only for transmitting torque to the corresponding photoconductors 2 but also for transmitting torque to the adjacent photoconductors 2 provided downstream from the corresponding photoconductors 2 in the direction of transmission of torque, thereby reducing production costs and installation space. In addition, each of the N number of drive gears 32 has substantially the same amount of eccentricity. As a result, it is not necessary to measure an amount of eccentricity of each of the drive gears 32 and to select a combination of the drive gears 32 that achieves predetermined eccentricity proportions in order to prevent rotary speed fluctuation caused by eccentricity of the drive gears 32. Further, as described above, use of the N number of drive gears 32 each having substantially the same amount of eccentricity can prevent rotary speed fluctuation in the photoconductors 2 caused by eccentricity of the corresponding drive gears 32 as well as rotary speed fluctuation caused by eccentricity of the drive gears 32 provided upstream from the corresponding drive gears 32 in the direction of transmission of torque.

Because the N number of drive gears 32 is formed by the same mold, production of the drive gears 32 each having the substantially the same amount of eccentricity can be easily achieved.

The image forming apparatus 100 according to the foregoing illustrative embodiments further includes the image forming units including the chargers, the developing devices, the irradiating device 1, and so forth. In the image forming units, an electrostatic latent image is written at the writing position SP on each of the surfaces of the N number of photoconductors 2 rotatively driven by the drive device 200. The electrostatic latent images thus formed are then developed with toner to form toner images of the respective colors. The input gear makes substantially the integer number of rotations while each of the surfaces of the N number of photoconductors 2 is rotated from the writing position SP to the transfer position TP. Accordingly, rotary speed fluctuation in the N number of photoconductors 2 caused by eccentricity of the input gear can be prevented.

Each of the N−1 number of idler gears makes substantially the integer number of rotations while each of the surfaces of the N number of photoconductors 2 is rotated from the writing position SP to the transfer position TP. Accordingly, rotary speed fluctuation in the N number of photoconductors 2 caused by eccentricity of the N−1 number of idler gear can be prevented.

In the first and second illustrative embodiments, the N number of drive gears 32 are provided coaxially to the rotary shafts of the corresponding photoconductors 2, thereby minimizing the number of idler gears.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

What is claimed is:

1. A drive device to rotatively drive N number of cylindrical image carriers arranged side by side along a direction of movement of a transfer member, where N is a positive integer equal to or greater than 2, the drive device comprising:

a single drive motor to generate torque to be transmitted to the N number of image carriers;

N number of drive gears including a first drive gear to transmit the torque to the N number of image carriers, respectively;

an input gear rotatively driven by the torque and engaging the first drive gear included among the N number of drive gears to transmit the torque to the first drive gear; and N−1 number of idler gears provided between each of the N number of drive gears, respectively, to transmit the torque from the drive gears provided on an upstream side in a direction of transmission of torque to the drive gears provided on a downstream side in the direction of transmission of torque, the torque generated by the drive motor being sequentially transmitted from the first drive gear to the Nth drive gear via the N−1 number of idler gears to rotatively drive the N number of image carriers, wherein:

each of the N number of drive gears has substantially the same amount of eccentricity;

the input gear, the N number of drive gears, and the N−1 number of idler gears are disposed to cause both a first setting angle between a first engagement point where the input gear engages the first drive gear and a second engagement point where a first idler gear included among the N−1 number of idler gears engages the first drive gear and a second setting angle between a third engagement point where the (n−1) th idler gear included among the N−1 number of idler gears, where n is a positive integer between 2 and (N−1), engages the nth drive gear included among the N number of drive gears and a fourth engagement point where the nth idler gear included among the N−1 number of idler gears engages the nth drive gear to be set to $\theta i$ obtained by a formula $\theta i=\pi-\phi\pm e$, where e is an acceptable amount of error; and the N number of drive gears are mounted to offset a rotational position of a point of maximum eccentricity in the nth drive gear from a rotational position of a point of maximum eccentricity in the first drive gear in a direction of rotation of the nth drive gear by an angle $\theta an$ obtained by a formula $\theta an=(n-1)\phi$ when n is an odd integer, and by an angle $\theta an$ obtained by a formula $\theta an=\theta i+(n-1)\phi$ when n is an even integer, where $\phi$ is obtained by a formula $$\phi = -2\pi\frac{(Ls - uLd)}{Ld}$$

when the N number of image carriers are arranged in order from the first image carrier to the Nth image carrier in the direction of movement of the transfer member, and is obtained by a formula $$\phi = 2\pi\frac{(Ls - uLd)}{Ld}$$

when the N number of image carriers are arranged in order from the first image carrier to the Nth image carrier in a direction opposite the direction of movement of the transfer member, where Ls is a distance between rotary shafts of each of two adjacent image carriers included among the N number of image carriers, Ld is a running distance of a surface of each of the N number of image carriers while each of the N number of drive gears makes a single rotation, and u is an integer representing a number of rotations made by each of the N number of drive gears while the transfer member is moved by Ls.

2. An image forming apparatus, comprising:

N number of rotatable cylindrical image carriers to form images on surfaces thereof, respectively, where N is a positive integer equal to or greater than 2;

a transfer member onto which the images are sequentially transferred one atop the other from the surfaces of the N number of image carriers arranged side by side along a direction of movement of the transfer member; and a drive device to rotatively drive the N number of image carriers, the drive device comprising:

a single drive motor to generate torque to be transmitted to the N number of image carriers;

N number of drive gears including a first drive gear to transmit the torque to the N number of image carriers, respectively;

an input gear rotatively driven by the torque and engaging the first drive gear included among the N number of drive gears to transmit the torque to the first drive gear; and N−1 number of idler gears provided between each of the N number of drive gears, respectively, to transmit the torque from the drive gears provided on an upstream side in a direction of transmission of torque to the drive gears provided on a downstream side in the direction of transmission of torque, the torque generated by the drive motor being sequentially transmitted from the first drive gear to the Nth drive gear via the N−1 number of idler gears to rotatively drive the N number of image carriers, wherein:

each of the N number of drive gears has substantially the same amount of eccentricity;

both a first setting angle between a first engagement point where the input gear engages the first drive gear and a second engagement point where a first idler gear included among the N−1 number of idler gears engages the first drive gear and a second setting angle between a third engagement point where the (n−1)th idler gear included among the N−1 number of idler gears, where n is a positive integer between 2 and (N−1), engages the nth drive gear included among the N number of drive gears and a fourth engagement point where the nth idler gear included among the N−1 number of idler gears engages the nth drive gear are set to θi obtained by a formula $\theta i=\pi-\phi\pm e$, where e is an acceptable amount of error; and a rotational position of a point of maximum eccentricity in the nth drive gear is offset from a rotational position of a point of maximum eccentricity in the first drive gear in a direction of rotation of the nth drive gear by an angle θan obtained by a formula $\theta an=(n-1)\phi$ when n is an odd integer, and by an angle θan obtained by a formula $\theta an=\theta i+(n-1)\phi$ when n is an even integer, where φ is obtained by a formula $$\phi = -2\pi\frac{(Ls - uLd)}{Ld}$$

when the N number of image carriers are arranged in order from the first image carrier to the Nth image carrier in the direction of movement of the transfer member, and is obtained by a formula $$\phi = 2\pi\frac{(Ls - uLd)}{Ld}$$

when the N number of image carriers are arranged in order from the first image carrier to the Nth image carrier in a direction opposite the direction of movement of the transfer member, where Ls is a distance between rotary shafts of each of two adjacent image carriers included among the N number of image carriers, Ld is a running distance of a surface of each of the N number of image carriers while each of the N number of drive gears makes a single rotation, and u is an integer representing a number of rotations made by each of the N number of drive gears while the transfer member is moved by Ls.

3. The image forming apparatus according to claim 2, further comprising an image forming unit to write latent images onto a predetermined writing position on each of the surfaces of the N number of image carriers to form the images by developing the latent images while the N number of image carriers are rotatively driven, wherein the input gear makes substantially an integer number of rotations while each of the surfaces of the N number of image carriers is rotated from the predetermined writing position to a transfer position opposite the transfer member.

4. The image forming apparatus according to claim 3, wherein each of the N−1 number of idler gears makes substantially an integer number of rotations while each of the surfaces of the N number of image carriers is rotated from the predetermined writing position to the transfer position.

5. The image forming apparatus according to claim 2, wherein the N number of drive gears are provided coaxially to rotary shafts of the respective image carriers.

* * * * *